US006176740B1

(12) United States Patent
Abe et al.

(10) Patent No.: US 6,176,740 B1
(45) **Date of Patent: *Jan. 23, 2001**

(54) TERMINAL LOCKING DEVICE EQUIPPED CONNECTOR

(75) Inventors: Kimihiro Abe; Tetsuya Yamashita, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/168,023

(22) Filed: Oct. 8, 1998

(30) Foreign Application Priority Data

Sep. 10, 1997 (JP) ..... 9-277594

(51) Int. Cl.[7] ..... H01R 13/436
(52) U.S. Cl. ..... 439/596; 439/752
(58) Field of Search ..... 439/752, 595, 439/596, 357

(56) References Cited

U.S. PATENT DOCUMENTS 5,700,163 * 12/1997 Okabe ..... 439/596
5,711,684 * 1/1998 Inoue et al. ..... 439/357
5,716,235 2/1998 Endo et al. ..... 439/596
5,782,647 * 7/1998 Okura et al. ..... 439/357

FOREIGN PATENT DOCUMENTS 2-49656 12/1990 (JP) .
8-185919 7/1996 (JP) .

* cited by examiner

*Primary Examiner*—Gary F. Paumen
(74) *Attorney, Agent, or Firm*—Armstrong, Westerman, Hattori, McLeland & Naughton

(57) ABSTRACT

A terminal locking device equipped connector is provided. This connector includes: a hood for protecting a terminal portion of a connector terminal; a terminal chamber connected to the hood for accommodating a wire connecting portion of the connector terminal; an engaging means formed integrally with the hood for maintaining an engaged state with a mating connector; a terminal locking device provided, by connected to said hood through a hinge, for locking the wire connecting portion; and a detachable provisionally-fixing member, disposed between a side surface of said engaging means and said terminal locking device, for provisionally fixing said terminal locking device in an open state. Thus, better workability particularly in accommodating a connector terminal in a terminal chamber can be realized.

12 Claims, 2 Drawing Sheets

TERMINAL LOCKING DEVICE EQUIPPED CONNECTOR

BACKGROUND OF THE INVENTION

1. Field of the Invention

The present invention relates to a terminal locking device-equipped connector.

2. Related Art

Japanese Utility Model Publication No. 2-49656 discloses a terminal locking device-equipped connector.

FIG. 5 is a sectional view of the terminal locking device-equipped connector 64 disclosed in the publication. A terminal locking device 65 is connected via a band hinge 67 to a housing 60 having a terminal chamber.

After the connector terminal is inserted into the terminal chamber, the terminal locking device 65 is engaged with the housing 60 so as to lock the connector terminal in the terminal chamber.

In the conventional terminal locking device-equipped connector, the hinge 67 is made so thin that the terminal locking device 65 can be easily engaged with the housing 60. The hinge 67 is also transformable so as not to hinder any attachment process by reacting.

Due to the thinness of the hinge 67, deformation or damage is often caused to the hinge and the terminal locking device, when the connector is repeatedly moved in manufacturing a wire harness.

Also, the terminal locking device is insecure at the time of attachment of the components, such as a connector terminal, by an automatic attachment machine, which further complicates the process of mounting to the automatic attachment machine. As a result, the terminal locking device hinders attachment of the components to the connector, thereby worsening the workability.

SUMMARY OF THE INVENTION

The principal object of the present invention is to provide a connector equipped with a terminal locking device which contributes to excellent workability by not hindering attachment of components to the connector.

In accordance with a first aspect of the present invention, the terminal locking device-equipped connector includes: a hood for protecting a terminal portion of a connector terminal; a terminal chamber connected to the hood for accommodating a wire connecting portion of the connector terminal; an engaging means formed integrally with the hood for maintaining an engaged state with a mating connector; a terminal locking device connected to the hood through a hinge, for locking the wire connecting portion; and a detachable provisionally-fixing member disposed between a side surface of the engaging means and the terminal locking device for provisionally fixing the terminal locking device in an open state.

In accordance with a second aspect of the present invention, the terminal locking device is fixed by the detachable provisionally-fixing member in an open state perpendicular to an axial direction of the connector terminal accommodated in the terminal chamber.

In accordance with a third aspect of the present invention, the detachable provisionally-fixing member is integrally formed in a state of connecting the side surface of the engaging means and the terminal locking device and is frangibly severed on closing the terminal locking device. With the terminal locking device being locked, it does not hinder attachment of the components to the connector, and excellent workability can be guaranteed.

In accordance with a fourth aspect of the present invention, the provisionally-fixing member is provided with a thin portion for easier severance. By virtue of the thin portion, the provisionally-fixing member can be easily frangibly severed without the use of any special device, which makes attachment of the terminal locking device easier.

In accordance with a fifth aspect of the present invention, the engaging means includes a slit to be engaged with an engaging protrusion of the mating connector.

The above and other objects and features of the present invention will become more apparent from the following description taken in conjunction with the accompanying drawings.

DETAILED DESCRIPTION OF THE PREFERRED EMBODIMENTS

Figure 1:
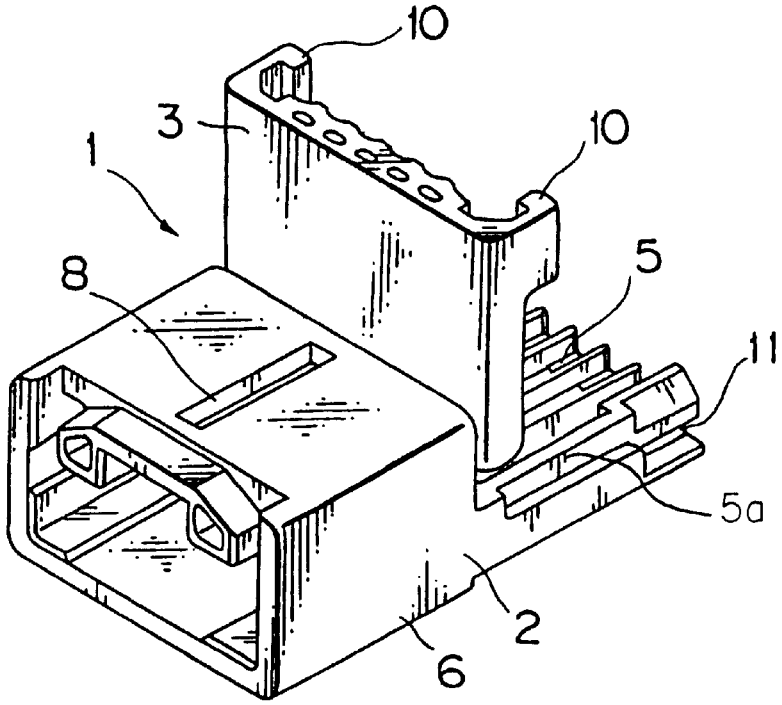
FIG. 1 is a perspective view of one embodiment of the present invention.

The following is a description of an embodiment of the present invention, with reference to the accompanying drawings.

In the drawings, a terminal locking device equipped connector 1 which is made of resin comprises a female housing main body 2 and a terminal locking device 3 integrally connected to the housing main body 2 by a transformable hinge 4.

The housing main body 2 is provided with a terminal chamber 5 for accomodating the wire connecting portion 7*a* of a connector terminal 7 in the rear, and a hood 6 for protecting the terminal portion 7*b* of the connector terminal 7 in the front.

The terminal chamber 5 is integrally formed at the rear end of the hood 6 and includes a lower cradle portion 5*a* whereby the upper surface of the terminal chamber 5 is open, so that the connector terminal 7 is inserted from the open side, and so that the wire connecting portion 7*a* is easily received by the terminal chamber 5 The upper portion of the terminal chamber is defined by the terminal locking device 3 which is separate from the lower cradle portion 5*a* and, when closed, cooperates with the lower cradle portion to form the terminal chamber enclosing a terminal 7 installed in the cradle portion.

Reference numeral 8 indicates an engaging slit for maintaining engagement between the connector and a mating male connector (not shown). The engaging slit 8 is engaged with an engaging protrusion provided to the hood of the mating connector so as to connect both connectors.

In this embodiment, a surface of the hood 6 which extends from the open surface of the terminal chamber 5 is made higher, so that the surface through which the engaging slit 8 extends is the surface of the hood 6.

The terminal locking device 3, when open, stands vertically at the rear end of the hood 6 with the transformable hinge 4 that extends between the rear side of the hood 6 and the lower end of the terminal locking device as its support shaft, and is temporarily supported by a provisionally-fixing strut 9 which is formed to extend between the terminal locking device 3 at a location above the hinge 4 and an adjacent portion of a stand wall 6*a* of the housing main body 2 disposed for forming the engaging slit 8. As shown best in FIGS. 1 and 2, the engaging slit 8 is thereby exposed when the terminal locking device is in both its open and its closed position.

Figure 4:
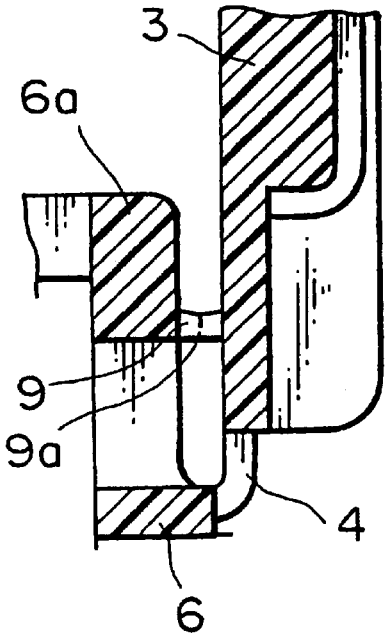
FIG. 4 is an enlarged sectional view of the provisionally-fixing hinge.
Figure 5:
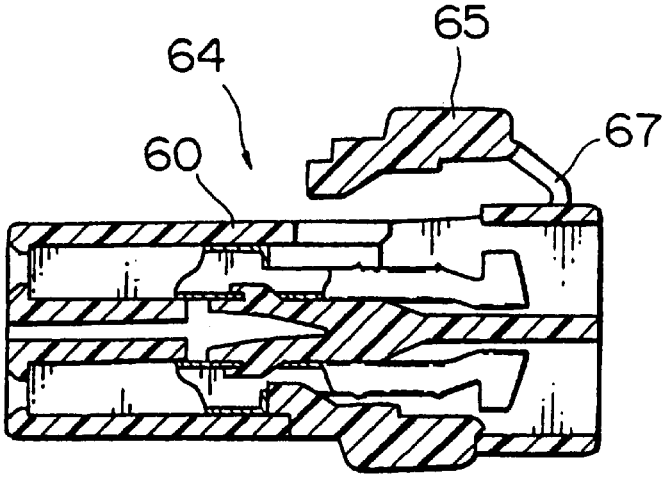
FIG. 5 PRIOR ART
FIG. 5 is a sectional view of a terminal locking device equipped connector of the prior art.

The provisionally-fixing strut 9 is integrally formed with the housing main body 2 and the terminal locking device 3. Even if external force acts on the terminal locking device 3, the provisionally-fixing strut 9 is not easily broken. However, a thin portion 9*a* is formed for easy frangible severance by hand or with a simple device, as shown in FIG. 4.

The provisionally-fixing strut 9 may be replaced with a frangible provisionally-fixing member for provisionally fixing the terminal locking device 3.

After the wire connecting portion 7a is inserted into the terminal chamber 5, the wire is pressed and connected to an automatic assembling machine, or the like. During such procedure, the terminal locking device 3 is temporarily locked by the provisionally-fixing strut 9, so that insertion of the connection terminal 7 and attachment process can be smoothly performed.

After the wire is connected to the wire connecting portion 7*a* of the connection terminal 7, the provisionally-fixing strut 9 for provisionally fixing the terminal locking device 3 is severed by hand or with a cutting device. By doing so, the terminal locking device 3 is released from its vertically disposed provisionally-fixing state, and made rotatable about the transformable hinge 4.

Figure 2:
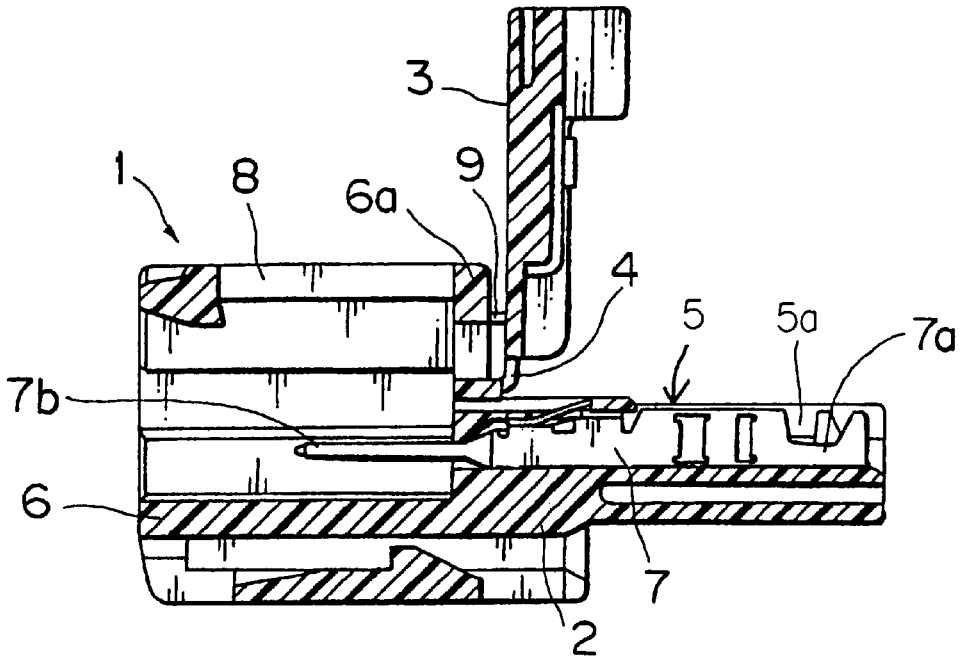
FIG. 2 is a sectional view of the terminal locking device of FIG. 1 in a temporary locked state.
Figure 3:
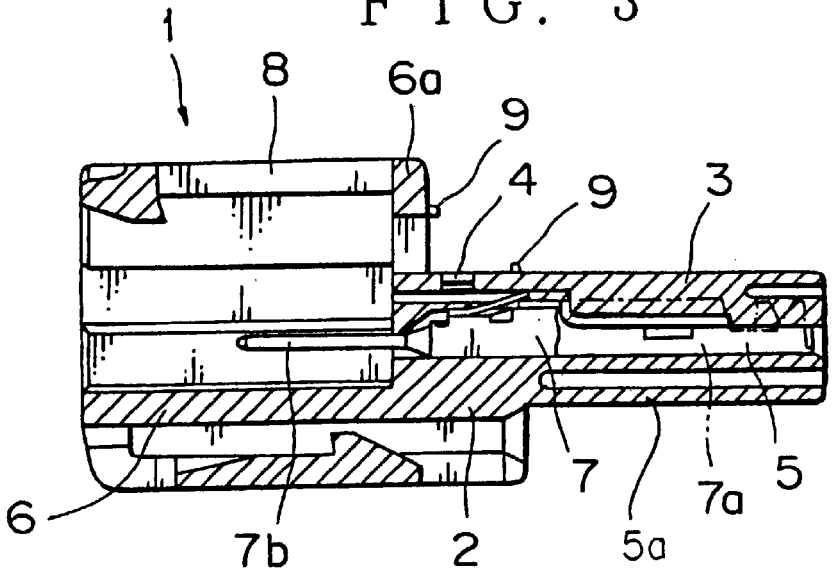
FIG. 3 is a sectional view of the terminal locking device of FIG. 1 in an attached state.

When the terminal locking device 3 is rotatively pushed toward the cradle portion 5*a* of the terminal chamber 5, engaging protrusions 10 formed on both ends of the terminal locking device 3 are engaged with engaging grooves 11 on the housing main body 2, as shown in FIG. 1. Thus, the attachment process becomes complete. With the terminal locking device 3 in an engaged state, with respect to the cradle portion 5*a* of the terminal chamber 5 the wire connecting portion 7*a* of the connector terminal 7 installed in the cradle portion of the terminal chamber 5 is enclosed and thereby is protected from external force, and lifting of the wire connecting portion 7*a* can be prevented by the locked relationship between the engaging protrusions 10 on the bottom surface of the terminal locking device 3 and the engaging grooves on the cradle portion 5*a*.

In the female housing of this embodiment, the surface to which the engaging slit is provided as an engaging means with the mating connector forms part of the hood. However, a surface having an engaging slit may be provided separately from the hood. Also, an engaging protrusion as an engaging means may be provided to the hood, and a provisionally-fixing hinge may be employed between the standing surface and the terminal locking device.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A terminal locking device-equipped connector, comprising:

a female housing main body containing a hood for protecting a connector terminal portion of a mating connector terminal at one end and a terminal chamber for accommodating a wire-connecting terminal at the other end;

said terminal chamber including a lower cradle portion having an exposed upwardly facing surface adapted to receive said wire-connecting terminal, and a terminal locking device separate from said cradle portion and cooperable therewith, when closed, to form an enclosure about a wire-connecting terminal received in said lower cradle portion, said hood containing generally rectangularly disposed side walls and a stand wall upstanding from said lower cradle portion on a rear side of said hood, said terminal locking device being connected to said hood by a hinge extending between said stand wall and a lower end of said terminal locking device, said hinge permitting rotation of said terminal locking device from an open position adjacent said stand wall to a closed position in which said terminal locking device is superposed upon said lower cradle portion to define said terminal chamber, and a severable provisionally-fixing member extending between, and interconnecting, said stand wall of said hood and said terminal locking device for provisionally fixing said terminal locking device in said open position to expose said cradle portion of said terminal chamber for reception of a wire-connecting terminal, said fixing member, when severed, permitting rotation of said terminal locking device about said hinge to its closed position defining said terminal chamber for enclosing said wire-connecting terminal.

2. A terminal locking device-equipped connector according to claim 1 wherein said hood contains an engaging slit in a side wall defining an upper surface of said hood, said terminal locking device supporting hinge connecting with said stand wall of said hood at a location below said engaging slit-containing surface, whereby said terminal locking device is prevented from undergoing pivotal movement toward said engaging slit.

3. A terminal locking device-equipped connector according to claim 1 in which said severable provisionally-fixing member is defined by a frangible strut which is integrally formed between the stand wall surface on the rear side of said hood and said terminal locking device and frangibly severed on closing said terminal locking device.

4. A terminal locking device-equipped connector according to claim 2 in which said severable provisionally-fixing member is defined by a frangible strut which is integrally formed between the stand wall surface on the rear side of said hood and said terminal locking device and frangibly severed on closing said terminal locking device.

5. A terminal locking device-equipped connector according to claim 3 further comprising a thin portion on said frangible strut to facilitate severence.

6. A terminal locking device-equipped connector according to claim 4 further comprising a thin portion on said frangible strut to facilitate severence.

7. The terminal locking device-equipped connector according to claim 1, wherein said engaging slit is operative to be engaged by an engaging protrusion of the mating connector.

8. The terminal locking device-equipped connector according to claim 2, wherein said engaging slit is operative to be engaged by an engaging protrusion of the mating connector.

9. The terminal locking device-equipped connector according to claim 3, wherein said engaging slit is operative to be engaged by an engaging protrusion of the mating connector.

10. The terminal locking device-equipped connector according to claim 4, wherein said engaging slit is operative to be engaged by an engaging protrusion of the mating connector.

11. The terminal locking device-equipped connector according to claim 5, wherein said engaging slit is operative to be engaged by an engaging protrusion of the mating connector.

12. The terminal locking device-equipped connector according to claim 6, wherein said engaging slit is operative to be engaged by an engaging protrusion of the mating connector.

* * * * *

UNITED STATES PATENT AND TRADEMARK OFFICE

CERTIFICATE OF CORRECTION

PATENT NO. : 6,176,740 B1
DATED : January 23, 2001
INVENTOR(S) : Abe, et al.

It is certified that error appears in the above-identified patent and that said Letters Patent is hereby corrected as shown below:

Title page,
Under [30] Foreign Application Priority Data:
The Priority Date should read -- October 9, 1997 --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*